US006079097A

United States Patent [19]

Henrici et al.

[11] Patent Number: 6,079,097

[45] Date of Patent: Jun. 27, 2000

[54] WIRE-CONNECTING APPARATUS

[75] Inventors: Dieter Henrici, Arnsberg; Karl Friedrich Kämper, Bergneustadt; Ludger Niebecker, Menden; Wolfgang Hohorst, Minden, all of Germany

[73] Assignees: Brokelmann, Jaeger & Busse, GmbH & Co., Arnsberg; Wago Kontakttechnik GmbH, Minden, both of Germany

[21] Appl. No.: 09/209,163

[22] Filed: Dec. 10, 1998

[30] Foreign Application Priority Data

Dec. 19, 1997 [DE] Germany ..... 197 56 750

[51] Int. Cl.[7] ..... H01R 43/052

[52] U.S. Cl. ..... 29/748; 29/754; 29/861; 140/92.1

[58] Field of Search ..... 29/748, 861, 33 F, 29/745, 752, 753, 754; 140/92.1

[56] References Cited

U.S. PATENT DOCUMENTS 4,617,731 10/1986 Carrell et al. ..... 29/861
5,465,478 11/1995 Anderson et al. ..... 29/748
5,909,913 6/1999 Fitz, Jr. et al. ..... 29/753

FOREIGN PATENT DOCUMENTS 44 31 254 3/1996 Germany .
0216727 8/1989 Japan ..... 29/745

*Primary Examiner*—Stephen F. Gerrity
*Assistant Examiner*—Rhonda Sands
*Attorney, Agent, or Firm*—Herbert Dubno; Andrew Wilford

[57] ABSTRACT

An apparatus for installing between a pair of spaced terminals a wire having a conductive core and an insulating sheath surrounding the core and interrupted at spaced stripped regions has a head defining a passage having an outer end, a guide element on the head at the outer end forming a passage alignable with the head passage, and a supply for feeding the wire along the head passage and the guide-element passage. A cutter on the head at the outer end can sever through the core in the stripped regions between the head and the guide element and the guide element can be pivoted on the head about an axis transverse to the guide-element passage for directing the passage at any of a plurality of different angles to the horizontal and vertical.

9 Claims, 6 Drawing Sheets

WIRE-CONNECTING APPARATUS

FIELD OF THE INVENTION

The present invention relates to a wire-connecting apparatus. More particularly this invention concerns a device which connects opposite ends of a piece of wire to two separate terminals, for instance on a circuit board or piece of electrical equipment.

BACKGROUND OF THE INVENTION

German patent document 4,431,254 of Tennie describes such a wiring apparatus to which is fed a continuous length of wire from which the insulation has been stripped at spaced locations to reveal the conductor. The wire is fed downward through the wiring apparatus and then is deflected horizontally through a guide head so that a stripped leading end of the wire projects from a front face of this head. The leading wire end is gripped just back of the stripped leading end by the head which can be moved relative to a first terminal to insert the wire into this terminal to form the desired connection. Then the wire is advanced through the head until the next stripped portion is immediately downstream of the head which again grips the wire as a cutter severs the conductor in the center of the stripped portion and the length of wire from the supply is displaced out of the way, leaving a stripped conductor projecting from the back of the gripper head. This head is then displaced to engage this trailing end of the cut-off piece with a second terminal and the wire is released from the head. The wire-feed system is lowered to insert the leading end of the wire through the head and the cycle is repeated.

Obviously this piece of equipment is fairly complex and therefore quite prone to failure. The wire follows a non-straight path through the device so it can jam or kink. Refeeding the wire through the guide eye after each cycle is problematic since it requires all the parts to realign themselves perfectly, otherwise the wire will jam and bring the production line down.

This system envisions turning the gripper head about a vertical axis so that the wire can be advanced in any horizontal direction, that is along a horizontal plane or a plane perpendicular to the normally vertical rotation axis of the gripper head. It is impossible, however, to insert the wire vertically or at an oblique angle between the vertical and horizontal. Thus even though the device may be mounted on a robot arm movable fully in x, y, and z directions, it cannot be used for certain types of installations.

OBJECTS OF THE INVENTION

It is therefore an object of the present invention to provide an improved wiring apparatus.

Another object is the provision of such an improved wiring apparatus which overcomes the above-given disadvantages, that is which is particularly resistant to jamming of the wire and which can insert the stripped wire end in any direction into a terminal.

SUMMARY OF THE INVENTION

An apparatus for installing between a pair of spaced terminals a wire having a conductive core and an insulating sheath surrounding the core and interrupted at spaced stripped regions has according to the invention a head defining a passage having an outer end, a guide element on the head at the outer end forming a passage alignable with the head passage, and a supply for feeding the wire along the head passage and the guide-element passage. A cutter on the head at the outer end can sever through the core in the stripped regions between the head and the guide element and the guide element can be pivoted on the head about an axis transverse to the guide-element passage for directing the passage at any of a plurality of different angles to the horizontal and vertical.

Thus with this system the head can point the wire horizontally, vertically, or at any oblique angle therebetween. Thus wiring can be affixed by a robot arm carrying the wiring head to all types of terminals provided on floor or side walls of various different pieces of equipment. Unlike the prior-art systems, both ends of the wire can be inserted in the same direction into identically oriented but spaced terminals.

The guide element according to the invention is formed with an axially open groove forming the respective passage. In addition the apparatus has a retaining member displaceable axially of the guide element and movable into a position closing the groove laterally. The groove has a depth equal to less than a diameter of the wire and is V-shaped. The retaining member is movable between an inner position compressing the wire in the groove against the guide element, an intermediate position closing the groove but permitting the wire to slide along the groove, and an outer position permitting the wire to move freely out of the groove. This retaining member is pivotal on the head adjacent the guide element. A motor mounted on the head pivots the guide element and a pneumatic cylinder on the head pivots the retaining member. For easiest threading of the wire through the guide-element passage the groove has opposite outwardly flared ends.

BRIEF DESCRIPTION OF THE DRAWING

The above and other objects, features, and advantages will become more readily apparent from the following description, reference being made to the accompanying drawing in which.

SPECIFIC DESCRIPTION

Figure 1:
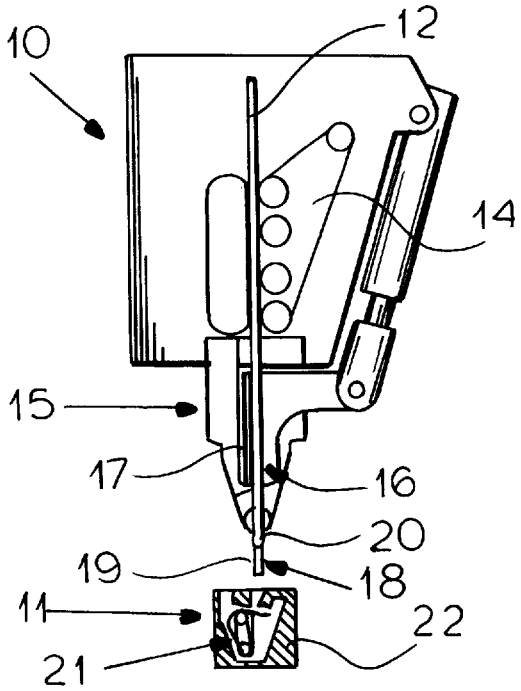
FIGS. 1 to 4 are partly diagrammatic and sectional small-scale side views illustrating the apparatus of this invention in four succeeding positions of a wiring cycle.

As seen in FIGS. 1 to 4, the wiring apparatus 10 according to the invention is supplied with a wire 12 having a metallic core 19 running inside an insulation sheath 20 and exposed at a leading end 18 of the wire 12 and at uniformly spaced locations 13 therealong. The wire 12 is fed along an axis 12' (FIG. 5) in a direction 12" by a feed device 14 of conventional construction, the direction 12" being vertical and extending down toward a wiring head indicated generically at 15. The apparatus 10 serves to connect a length 24 of the wire 12 between a pair of upwardly open terminals 11 and 11' separated by a horizontal distance a, each terminal 11 and 11' comprising a gripper contact 21 and a body 22. To this end the head 15 can be moved relative to the terminals 11 and 11' as shown by arrow 23, either by moving the head 15 or by moving the piece of electrical equipment (here a lamp) carrying the terminals 11 and 11'.

The head 15 forms a vertical passage 17 through which the wire 12 can be fed in the direction 12" by the device 14. An outlet end 17' (FIG. 5) of the passage 17 is formed in a cutter element 27 that can be pivoted as shown by arrow 30 relative to a fixed counter blade 28 of the head 15 by means of an actuator 29 to cut through the wire 12, normally in the center of a bare region 13 to form a pair of conductor ends 19' and 19". The elements 27 and 28 together form a cutter 16.

Figure 6:
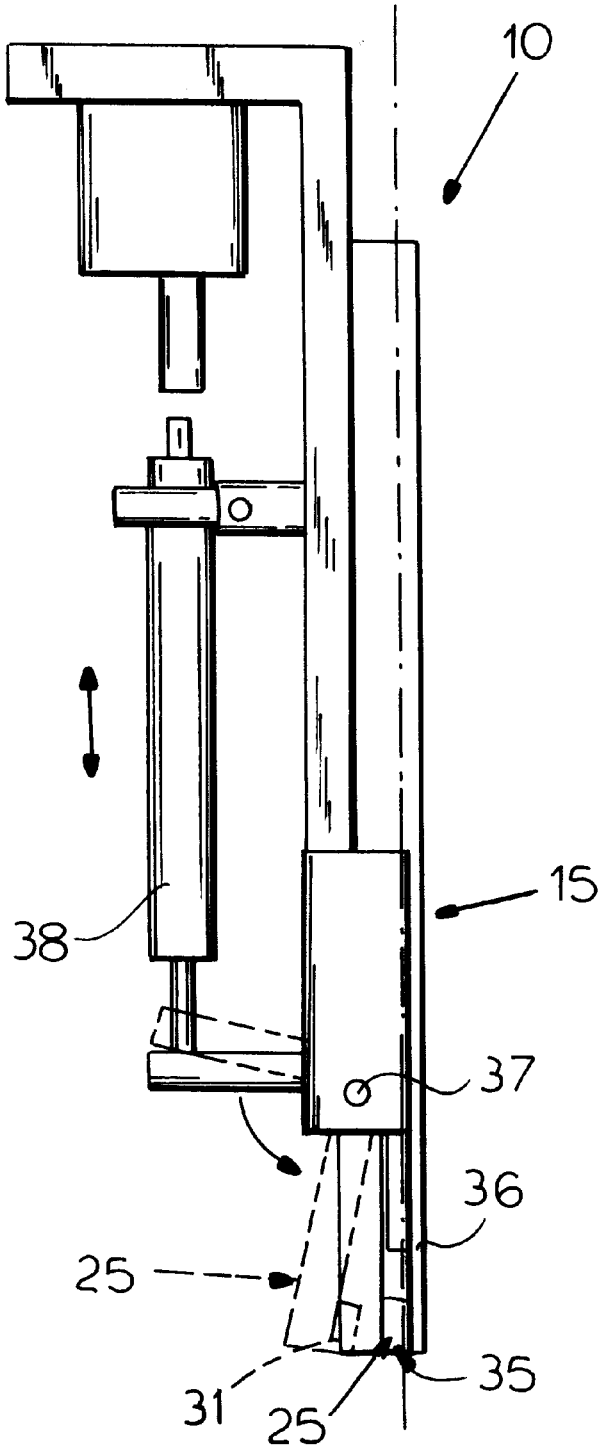
FIG. 6 is a view taken in the direction of arrow VI of FIG. 5.
Figure 10:
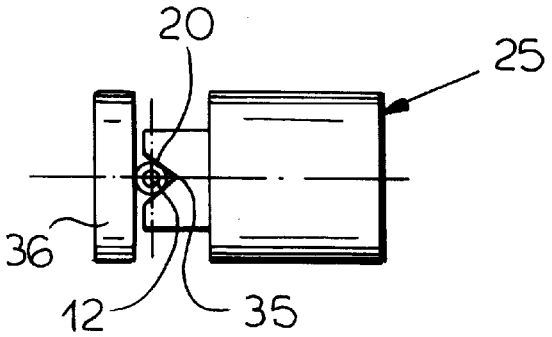
FIG. 10 is a section taken along line X—X of FIG. 8.
Figure 8:
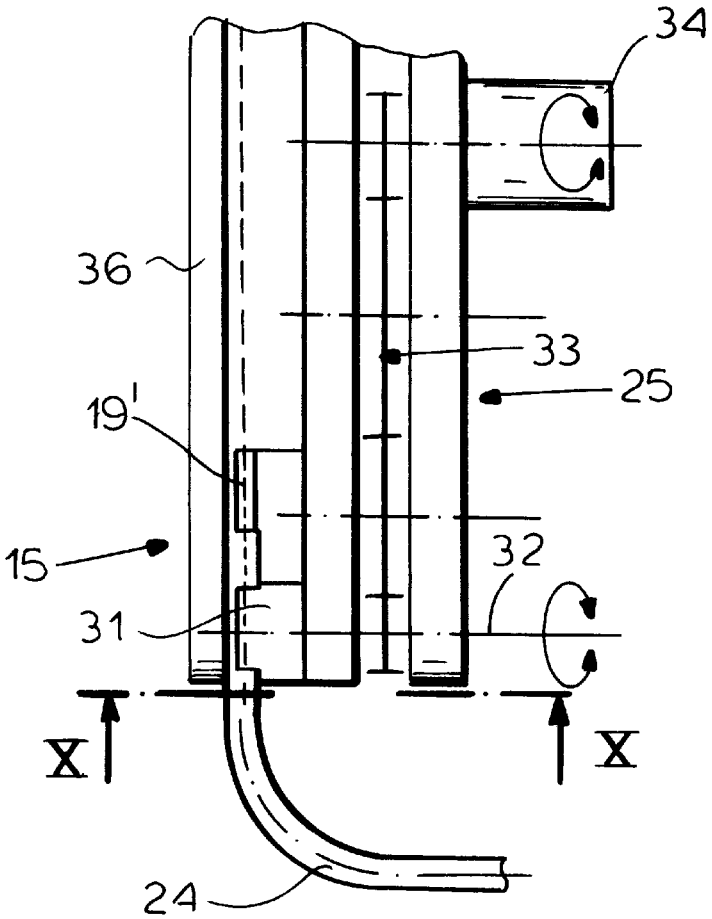
FIG. 8 is a view taken in the direction of arrow VIII of FIG. 7.

Below the cutter 16 the head 15 has a guide tip 25 formed by a member 31 rotatable about an axis 32 as shown by arrow 26 and forming a diametral guide groove 35 that together with a retaining member 36 forms a continuation of the passage 17. The member 31 is rotatable about the axis 32 (FIG. 8) through a transmission 33 by a motor 34 carried on the head 15. The retaining member 36 is pivotal about a horizontal axis 37 on the head 15 by an actuator 38 and is movable from an innermost end position in which it clamps the wire 12 tightly in the V-shaped (see FIG. 10) guide groove 35, through an intermediate position spaced slightly outward from the guide member 31 and allowing the wire 12 to slide along the groove 35, to an outermost position shown in dashed lines in FIG. 6 in which the wire 12 can come completely out of the guide groove 35.

The apparatus 10 described above operates as follows:

To start with the wire 12 is oriented as shown in FIG. 1 with the groove 35, whose opposite ends are outwardly flared to ease threading of the wire 12 through it, aligned vertically with the passage 17 and the member 36 pressing the leading end 18 into the groove 35 with such force that the wire 12 cannot move in the head 15. In this position the head 15 is oriented above the first terminal 11 and either this terminal 11 is lifted or the head 15 is dropped to poke the bared wire end 19 into the terminal 11 and secure it to the contact 21 thereof.

Figure 3:
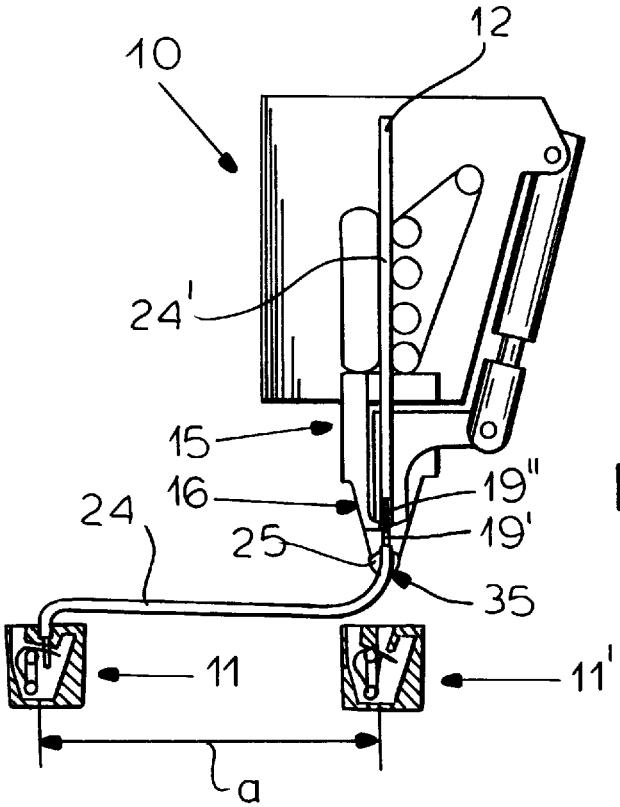
Figure 2:
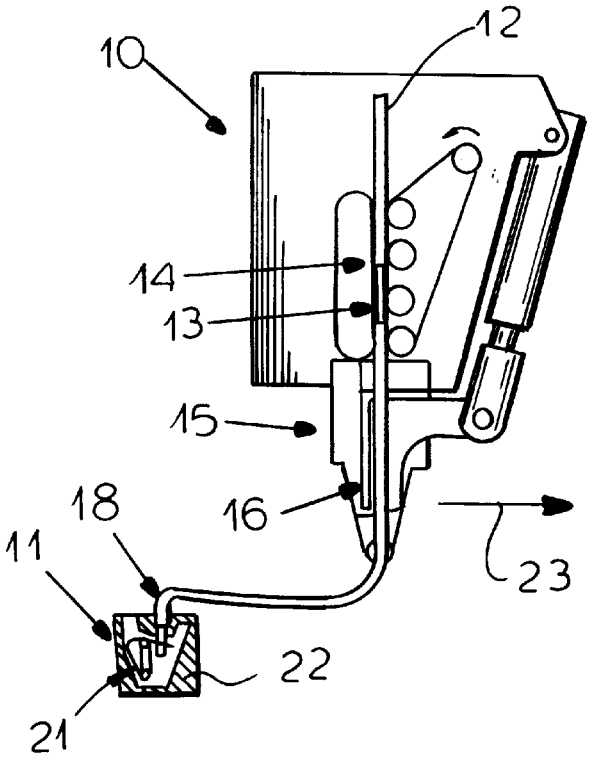
Figure 7:
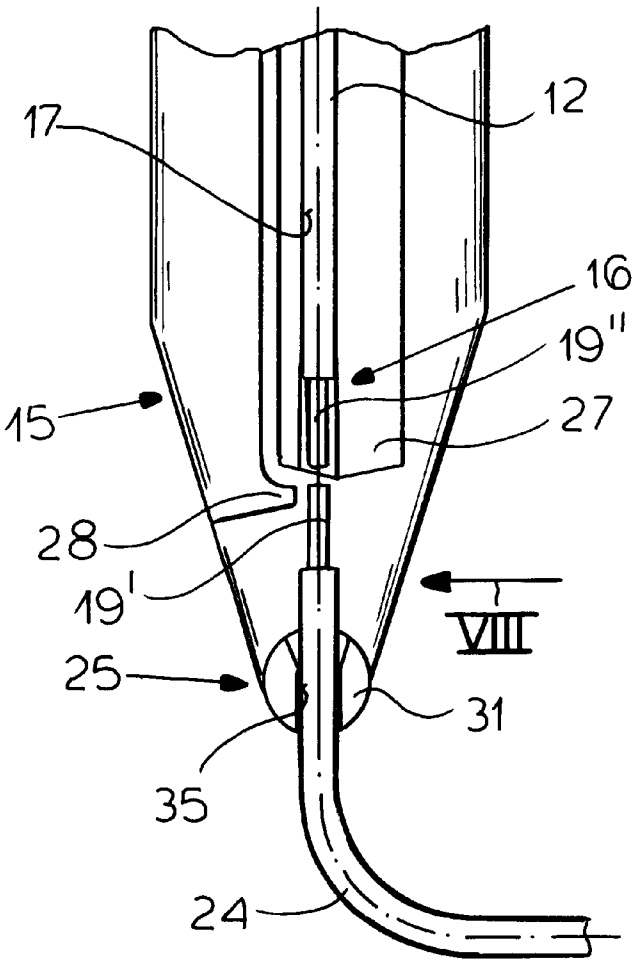
FIG. 7 is a larger-scale view of the tip of the wiring head of the apparatus.

Then as shown in FIG. 2 the member 36 is backed off slightly so the wire 12 can slide along the groove 35 and at the same time the wire feed 14 is operated while the head 15 is moved as shown by arrow 23 through the distance a, although it is of course possible to hold the head 15 stationary and move the terminals 11 and 11' instead. Thus the section 24 of wire pulls out of the head 15 until the next bared section 13 is positioned in the cutter 16 which is then is actuated to sever through the conductor 19, forming trailing and leading ends 19' and 19" as shown in FIGS. 3 and 7.

Figure 4:
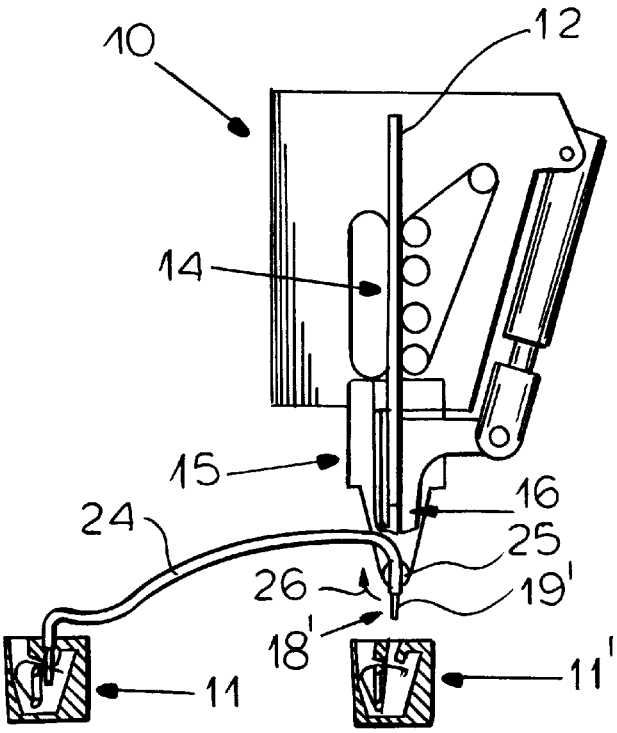
Figure 5:
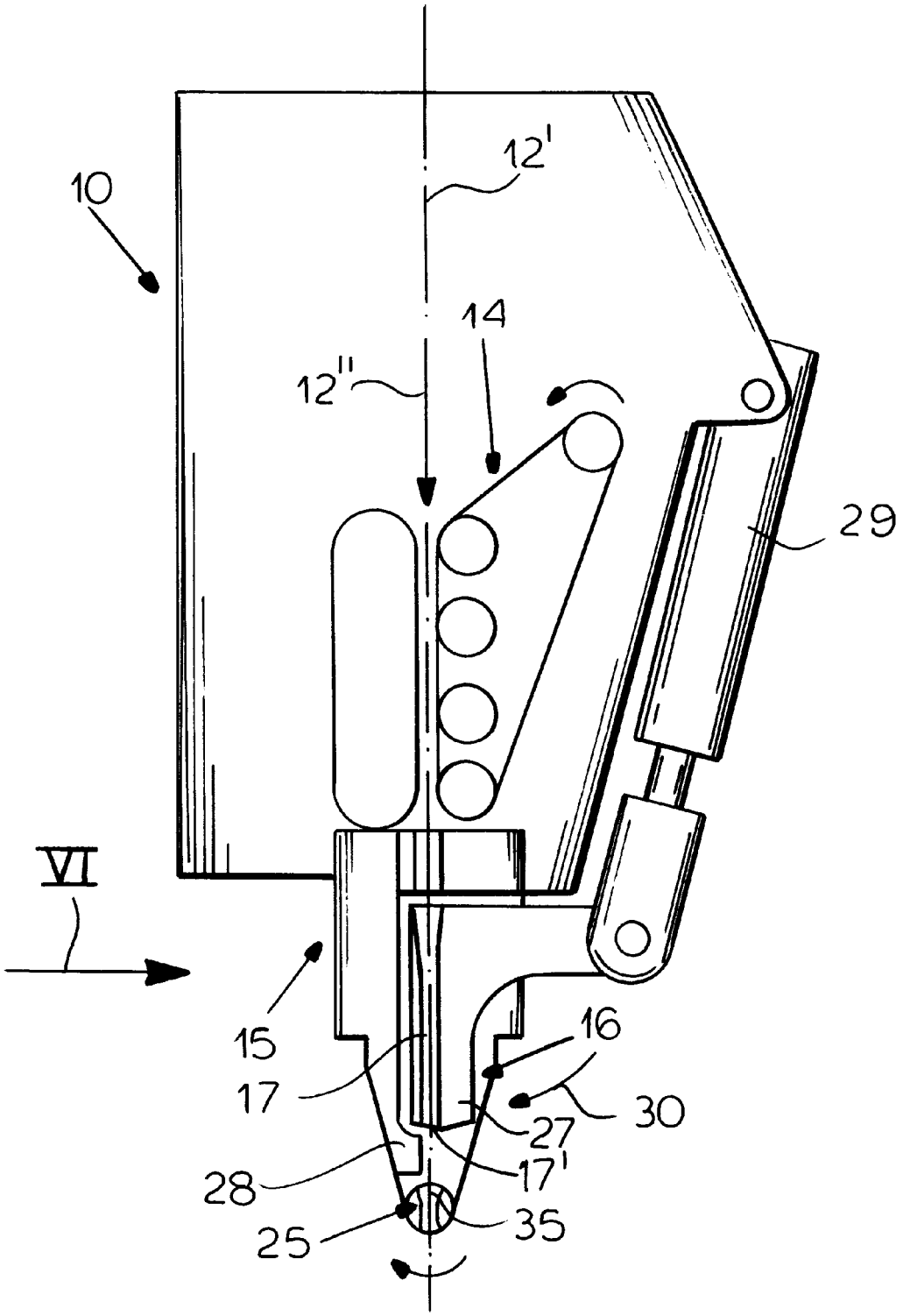
FIG. 5 is a larger-scale view of the wiring head of the apparatus.
Figure 9:
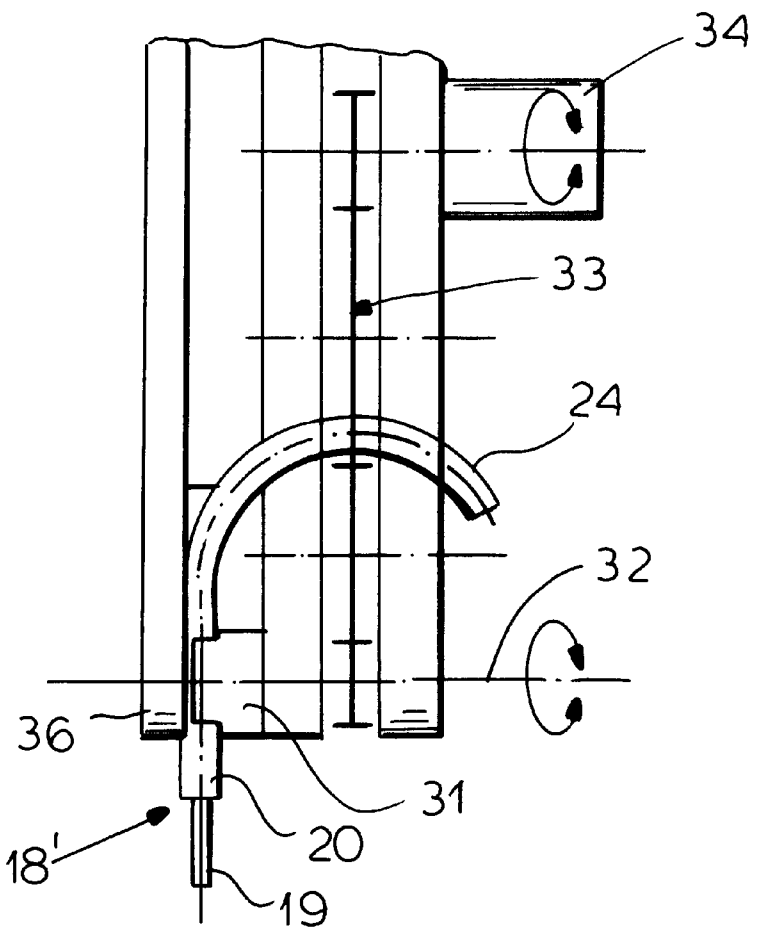
FIG. 9 is a view like FIG. 8 but showing the structure in an alternate position.

Subsequently as shown in FIGS. 4 and 9 the motor 34 is operated to rotate the guide member 31 through 180°, thereby orienting the bared tip 19' so it points downward rather than upward. The member 36 is pushed in again by the actuator 38 to clamp the thus formed trailing end 18' tightly in the guide tip 25 so that the head 15 can be dropped (or the terminal 11' raised) to stab the bared wire 19' into the terminal 11' and thereby form the second connection.

Subsequently the retaining member 36 is retracted to the intermediate position so the feed device 14 can advance the wire 12 enough that the next conductor tip 19" projects downward from the head 15 as in FIG. 1, whereupon it is again clamped by the member 36 and the cycle can be repeated.

While the description above refers always to insertion of the wire 12 in a vertical direction, it is of course possible for the same equipment to be used to insert it at an angle smaller than 90° to the horizontal, or even to insert it horizontally if that is needed. What is more, one end of the wire segment 24 can be inserted vertically and the next horizontally or obliquely, or vice versa, if needed so that the system of this invention can be used to wire a wide variety of different types of equipment.

We claim:

1. An apparatus for installing between a pair of spaced terminals a wire having a conductive core and an insulating sheath surrounding the core and interrupted at spaced stripped regions, the apparatus comprising:

a head defining a passage having an outer end;

a guide element on the head at the outer end forming a passage having a pair of opposite ends alignable with the head passage and pivotal on the head through about 180° between a position with one of the ends directed into the head passage and a position with the other of the ends directed into the head passage;

means for feeding the wire along the head passage and the guide-element passage in either position of the guide element;

means on the head at the outer end for cutting through the core in the stripped regions between the head and the guide element; and means for pivoting the guide element on the head about an axis transverse to the guide-element passage between the positions for directing the guide-element passage at any of a plurality of different angles to the horizontal and vertical and for aligning the guide-element passage with the head passage in each of the positions.

2. The wiring apparatus defined in claim 1 wherein the guide element is formed with an axially open groove forming the respective passage.

3. The wiring apparatus defined in claim 2, further comprising a retaining member displaceable axially of the guide element and movable into a position closing the groove laterally.

4. The wiring apparatus defined in claim 3 wherein the groove has a depth equal to less than a diameter of the wire.

5. The wiring apparatus defined in claim 4 wherein the groove is V-shaped.

6. The wiring apparatus defined in claim 4 wherein the retaining member is movable between an inner position compressing the wire in the groove against the guide element, an intermediate position closing the groove but permitting the wire to slide along the groove, and an outer position permitting the wire to move freely out of the groove.

7. The wiring apparatus defined in claim 6 wherein the retaining member is pivotal on the head adjacent the guide element.

8. The wiring apparatus defined in claim 1 wherein the means for pivoting includes a motor mounted on the head.

9. The wiring apparatus defined in claim 1 wherein the passage has opposite outwardly flared ends.

* * * * *